US011318628B2

(12) United States Patent
Jaber

(10) Patent No.: US 11,318,628 B2
(45) Date of Patent: May 3, 2022

(54) POWERED HAIR CLIPPERS WITH BLADE ASSEMBLIES INCLUDING PATTERNED RIB ARRAYS

(71) Applicant: CareFusion 2200, Inc., San Diego, CA (US)

(72) Inventor: Anas Jaber, Schaumburg, IL (US)

(73) Assignee: CareFusion 2200, Inc., San Diego, CA (US)

( * ) Notice: Subject to any disclaimer, the term of this patent is extended or adjusted under 35 U.S.C. 154(b) by 177 days.

(21) Appl. No.: 16/743,385

(22) Filed: Jan. 15, 2020

(65) Prior Publication Data

US 2020/0223077 A1 Jul. 16, 2020

Related U.S. Application Data

(60) Provisional application No. 62/792,584, filed on Jan. 15, 2019.

(51) Int. Cl.
*B26B 19/38* (2006.01)

(52) U.S. Cl.
CPC ..... *B26B 19/3846* (2013.01); *B26B 19/3853* (2013.01)

(58) Field of Classification Search
None
See application file for complete search history.

(56) References Cited

U.S. PATENT DOCUMENTS 2,291,439 A * 7/1942 Andis ..... B26B 19/3846 30/123
3,871,077 A 3/1975 Nissen et al.
9,713,877 B2 * 7/2017 Mintz ..... B26B 19/3813
9,815,215 B2 11/2017 Uit De Bulten et al.
2009/0106981 A1 4/2009 Palmer et al.
2012/0110859 A1 5/2012 Kammer
2014/0053412 A1 2/2014 Carlucci et al.
2016/0129601 A1 5/2016 Kammer et al.
2016/0129602 A1 5/2016 Mintz et al.
2016/0354939 A1 * 12/2016 Hill ..... B26B 21/4068
2016/0361826 A1 12/2016 Musallam (Continued)

FOREIGN PATENT DOCUMENTS

DE 102011008314 A1 7/2012
EP 1295686 A1 3/2003

OTHER PUBLICATIONS

International Search Report of PCT/US2020/013635 dated May 20, 2020.

(Continued)

*Primary Examiner* — Hwei-Siu C Payer
(74) *Attorney, Agent, or Firm* — Dinsmore & Shohl LLP

(57) ABSTRACT

A hair clipper includes a clipper body comprising a motor and a blade assembly connected to the clipper body such that the motor moves a moveable blade of the blade assembly during operation. The blade assembly includes a blade housing having a guide surface that faces skin of a patient during operation and a patterned array of ribs that are located on the guide surface defining a guide plane. The ribs of the patterned array of ribs are arranged spaced-apart from one another and are sized to provide a kinetic friction force against dry skin of the patient of less than 1 N using a normal force of 3.5 N.

18 Claims, 6 Drawing Sheets

(56) References Cited

U.S. PATENT DOCUMENTS

| | | | | |
|---|---|---|---|---|
| 2019/0366569 | A1* | 12/2019 | Roth | B26B 21/4081 |
| 2020/0223077 | A1* | 7/2020 | Jaber | B26B 19/06 |
| 2020/0223078 | A1* | 7/2020 | Jaber | A61B 17/00 |

OTHER PUBLICATIONS

International Search Report of PCT/US2020/013640 dated Apr. 20, 2020.
International Search Report of PCT/US2020/013636 dated Mar. 30, 2020.

* cited by examiner

POWERED HAIR CLIPPERS WITH BLADE ASSEMBLIES INCLUDING PATTERNED RIB ARRAYS

CROSS-REFERENCE

This application claims the benefit of and priority to U.S. Provisional Patent Application No. 62/792,584, titled Powered Hair Clippers with Blade Assemblies Including Patterned Rib Arrays, filed Jan. 15, 2019, the details of which are incorporated by reference.

TECHNICAL FIELD

The present specification generally relates to powered hair clippers and, more specifically, to powered hair clippers with blade assemblies including patterned rib arrays that reduce contact area with skin.

BACKGROUND

Hair clippers are provided for hair removal. Some hair clippers may be suitable for everyday use and some hair clippers may be suitable for more specialized uses, such as in preparation for a medical procedure. The hair clippers generally include a blade assembly that includes a housing and a blade that extends outwardly from the housing. The housing may include a surface that glides along the skin as hair is being removed using the blade. The surface that contacts the skin may be flat thereby providing a relatively large percentage of surface area in contact with the skin under normal operating conditions. This increased contact area can also increase friction between the housing and the skin.

SUMMARY

In one embodiment, a hair clipper includes a clipper body comprising a motor and a blade assembly connected to the clipper body such that the motor moves a moveable blade of the blade assembly during operation. The blade assembly includes a blade housing having a guide surface that faces skin of a patient during operation and a patterned array of ribs that are located on the guide surface defining a guide plane. The ribs of the patterned array of ribs are arranged spaced-apart from one another and are sized to provide a kinetic friction force against dry skin of the patient of less than 1 N, such as less than 0.99 N using a normal force of 3.5 N.

In another embodiment, a hair clipper includes a clipper body including a motor and a blade assembly connected to the clipper body such that the motor moves a moveable blade of the blade assembly during operation. The blade assembly includes a blade housing having a guide surface that faces skin of a patient during operation and a patterned array of ribs that are located on the guide surface defining a guide plane. The patterned array of ribs includes outermost ribs that extend along opposite sides of the blade housing and central ribs that extend along an inboard region of the guide surface. The inboard region has a higher rib density than adjacent outboard regions.

In another embodiment, a method of using a hair clipper for hair removal from a skin area of a patient is provided. The method includes coupling a blade assembly to a clipper body of the hair clipper. The surgical clipper blade assembly includes a clipper body including a motor. A blade assembly is connected to the clipper body such that the motor moves a moveable blade of the blade assembly during operation. The blade assembly includes a blade housing having a guide surface that faces skin of a patient during operation and a patterned array of ribs that are located on the guide surface defining a guide plane. The ribs of the patterned array of ribs are arranged spaced-apart from one another and are sized to provide a kinetic friction force against dry skin of the patient of less than 1 N, such as less than 0.99 N using a normal force of 3.5 N. The guide surface faces toward the skin area such that the patterned array of ribs contacts the skin area. The blade assembly is operated to remove hair from the skin area.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are generally directed to powered hair clippers with blade assemblies including patterned rib arrays that reduce contact area with skin. The hair clippers include a clipper body and a blade assembly that is connected to a motor that is located in the blade body. The motor is used to oscillate a moveable blade of the blade assembly relative to a stationary blade of the blade assembly in order to cut hair as the blade assembly is moved across the skin. The blade assembly includes a blade housing that includes a guide surface that is used to guide the blade assembly along a skin surface. The patterned rib array is located on the guide surface and provides a reduced skin contact area compared to the guide surface itself. A reduced contact area can reduce friction and provide an improved hair removal experience.

Figure 1:
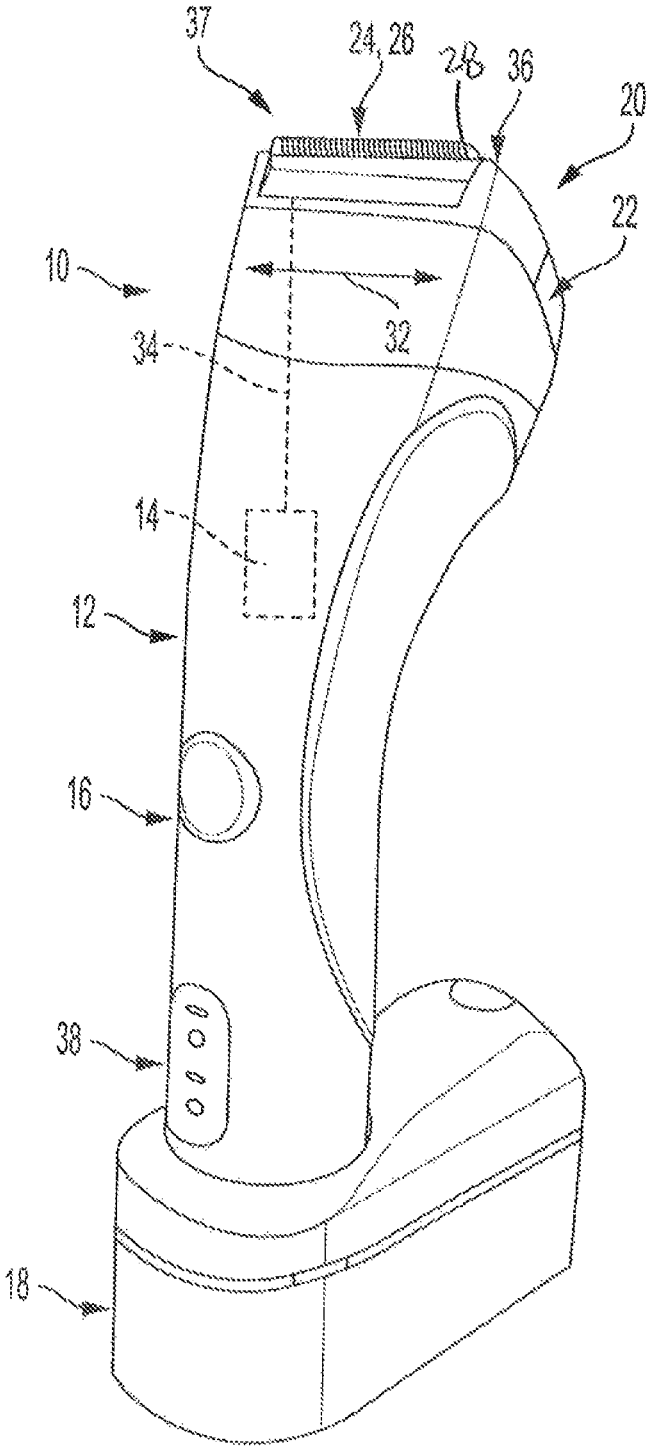
FIG. 1 is a perspective view of a hair clipper with charging station, according to one or more embodiments shown and described herein.

Referring to FIG. 1, a hair clipper 10 includes a clipper body 12 that provides a housing for components of the hair clipper, such as a motor (e.g., a rotary motor), which is illustrated schematically by element 14, and a user interface 16 that is used to control operation of the hair clipper 10. The clipper body 12 may further include a rechargeable battery (e.g., a lithium battery) that can be recharged using a charging station 18.

A blade assembly 20 is connected to the clipper body 12. The blade assembly 20 includes a blade housing 22 and a moveable blade 24 that extends outwardly from the blade housing 22. In some embodiments, the blade assembly 20 may be removable from the clipper body 12 and be disposable. In other embodiments, the blade assembly 20 may be a permanent part of the clipper body 12 and may not be intended to be removable without damage to the hair clipper 10. For removable blade assemblies 20, there may different blade assembly types, such as general purpose blade assembly for body hair, a neuro blade assembly for scalp and other thick, course hair and a sensitive blade assembly for perineal/sensitive areas. The blade assemblies may be intended for a single use.

Figure 4:
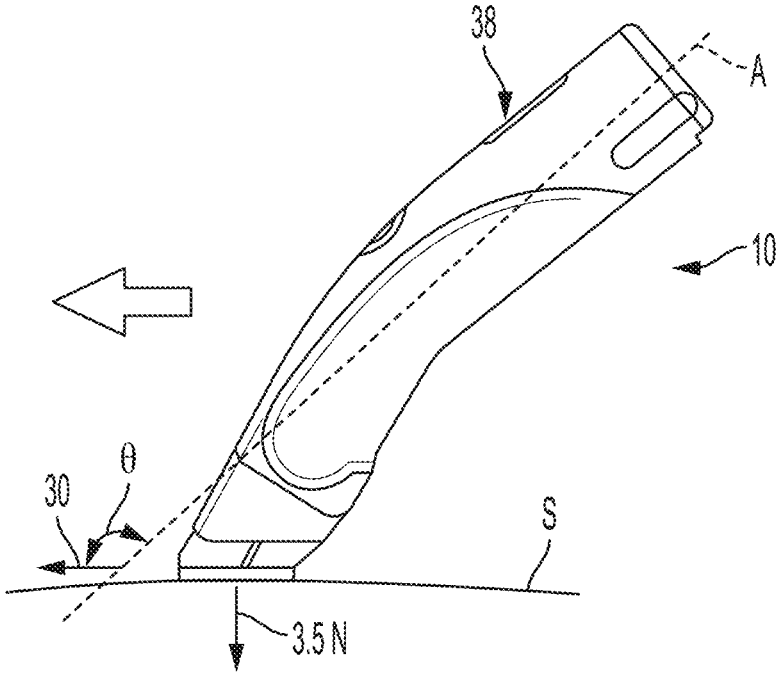
FIG. 4 is a side view of the hair clipper of FIG. 1 in use, according to one or more embodiments shown and described herein.

The blade assembly 20 includes the moveable blade 24 and a stationary blade 26 that both extend outwardly from a corner 28 of the blade housing 22 defining a blade cutting direction in the direction of arrow 30 (FIG. 4). The blades 24 and 26 have teeth that provide a comb-like shape across a width of the blades 24 and 26 defining a width direction in the direction of arrow 32 that is perpendicular to the blade cutting direction. The motor 14 reciprocates the moveable blade 24 in the width direction relative to the stationary blade 26 via a linkage 34 in order to cut hair located between the teeth.

The blade housing 22 includes a guide surface 36 that is located at a skin engagement end 37 of the hair clipper 10. The guide surface 36 faces the skin during a trimming operation. As can be seen, the guide surface 36 defines a plane that is substantially parallel with the cutting direction 30. In some embodiments, the cutting direction 30 and the guide surface 36 may be at an angle θ (e.g., between about 135 and about 145 degrees) that is oblique to a central axis A that passes through a base portion 38 of the clipper body 12 (FIG. 4).

Figure 2:
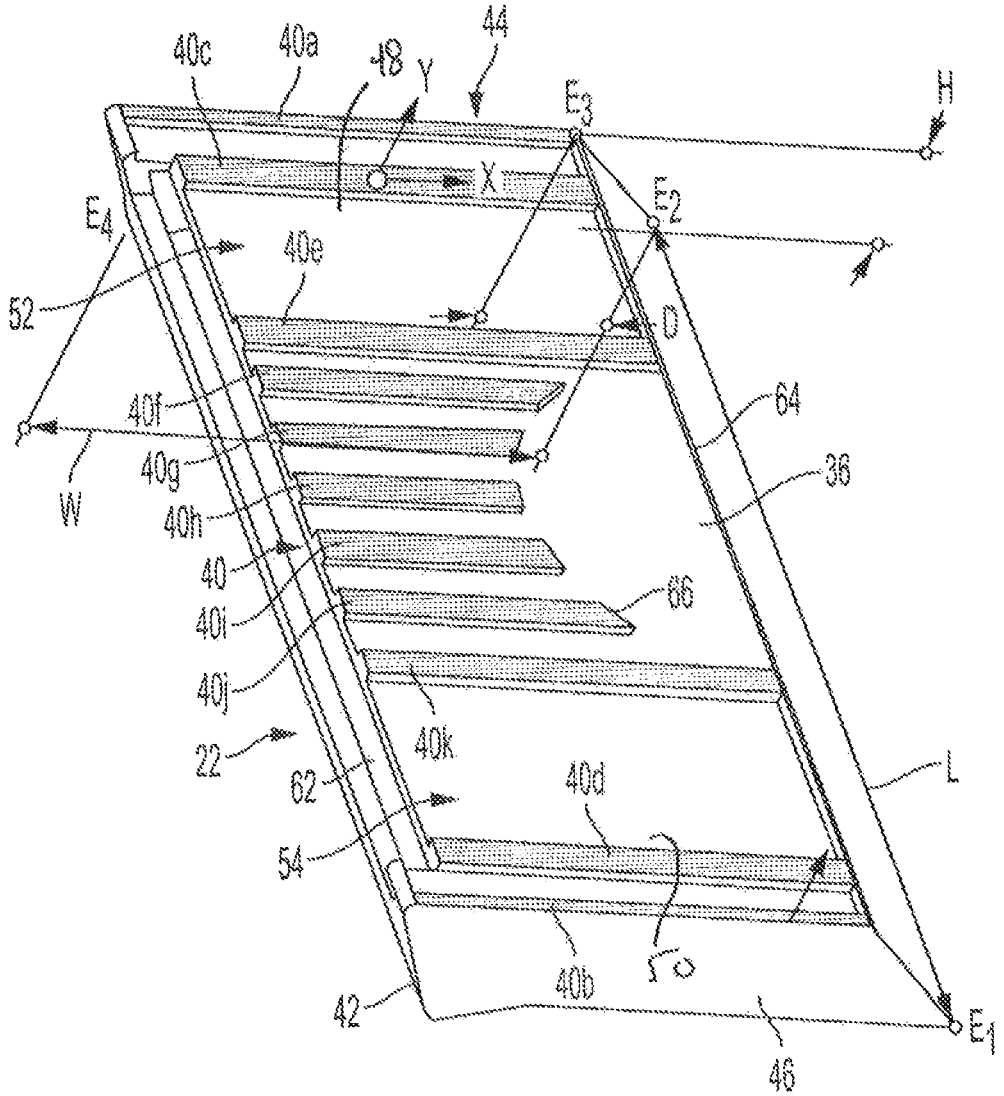
FIG. 2 is a perspective view of a blade housing for use with the hair clipper of FIG. 1, according to one or more embodiments shown and described herein.

Referring to FIG. 2, the blade housing 22 is illustrated in isolation. As can be seen, the guide surface 36 has a patterned array of ribs 40 located thereon. The ribs 40 are raised from the guide surface 36 to define a guide plane that is substantially parallel to the guide surface 36. In some embodiments, the ribs 40 may be raised between about 0.15 and about 4.5 mm, such as about 0.3 mm from the guide surface 36. A wall thickness beneath the guide surface 36 may be between about one mm and about 1.25 mm creating a ratio of height of the ribs 40 to wall thickness beneath the ribs 40 of between about 1:4 and about 1:3. In an XY coordinate plane including an X-axis and a Y-axis (Y being tangent to the guide surface 36 and X being parallel to the guide surface 36), FIG. 2 shows a length L between endpoints E1 and E2 at bottom edges of bottom surface 42, a vertical distance H along the Y-axis between endpoints E2 and E3 at a top edge of the guide surface 36, a horizontal distance D along the X-axis between endpoints E2 and E3, and a width W between endpoints E2 and E4 at an opposing bottom edge of the bottom surface 42. The length L may be, for example, approximately 48.30 mm, a radius of endpoint E2 may be 0.20 mm, a radius of endpoint E3 may be 0.50 mm, the vertical distance H may be 6 mm, the horizontal distance D may be 6.50 mm, and the width W may be 25.32 mm. Endpoint E2 may be angled with respect to endpoint E3 at about 42.71 degrees. In embodiments, the width W may be in a range of from about 40% to about 60% of the length L, and the vertical distance D may be in a range of from about 80% to 100% of the horizontal distance D and in a range of from about 5% to 20% of the length L.

The ribs 40 extend along a width of the guide surface 36. In particular, the patterned array of ribs 40 include outermost ribs 40*a* and 40*b* that extend along sides 44 and 46 of the blade housing 22. Inboard of the outermost ribs 40*a* and 40*b* are side ribs 40*c* and 40*d* that extend along sides 48 and 50 of the guide surface 36. The side ribs 40*c* and 40*d* extend the entire width of the guide surface 36. Interior ribs 40*e*-40*k* are located inboard of the side ribs 40*c* and 40*d* and are spaced inboard from the side ribs 40*c* and 40*d* providing spaced regions 52 and 54 that are devoid of ribs 40. In some embodiments, the spaced regions 52 and 54 may each be at least about 10 percent of the length of the guide surface 36, such as at least about 15 percent, such as at least about 20 percent of the length of the guide surface 36. In this regard, an inboard region 56 of the guide surface 36 may have a higher rib density per unit length than adjacent outboard regions 52 and 54.

Interior ribs 40*e* and 40*k* extend along sides of the inboard region 56 and each extends the entire width of the guide surface 36. Inboard of ribs 40*e* and 40*k* are central ribs 40*f*-40*j*. The central ribs 40*f*-40*j* only partially extend of the width of the guide surface 36, intersecting or beginning at front edge 62 of the guide surface 36 and terminating before rear edge 64. In some embodiments, rear edges 66 of the central ribs 40*f*-40*j* may be side beveled toward the sides 48 and 50 of the guide surface 36 thereby forming a somewhat rounded edge pattern. As can be seen, ribs 40*f* and 40*j* are longer than ribs 40*g*-40*i*, which are the shortest ribs 40. Each of the ribs 40 may have a length (in the X-direction) that is much greater than their width, such as at least about 2 times their width, such as at least about 3 times their width, such as at least about 4 times their width, such as at least about 5 times their width. Space is provided between the ribs 40*f*-40*j* to provide a somewhat undulating pattern of ribs and valleys.

The ribs 40 provide the guide plane having a reduced skin contact area compared to the area (W×L) of the guide surface 36. In some embodiments, the guide surface 36 may include a total surface area in a range from about 10 $cm^2$ to about 15 $cm^2$ and the array of ribs 40 disposed on the guide surface 36 that have a surface area (the stippled area of the array of ribs 40) in a range of from about 1.5 $cm^2$ to about 3 $cm^2$. As a non-limiting example, the guide surface 36 may include a total surface area of about 10 $cm^2$ and a plurality of ribs 40 that together have a surface area of about 2 $cm^2$, or less than about half the surface area of the guide surface 36, such as less than about 25 percent, such as less than about 20 percent of the surface area of the guide surface 36.

Providing the ribs 40 having a reduced skin contact area, along with the spaced regions 52 and 54 that are devoid of ribs can reduce friction against dry skin (i.e., unaltered by a foreign substance, such as a lotion or cleanser) during use. The ribs 40 can also reduce friction of wet skin including a substance, such as sage. Table I below illustrates friction force (N) for three different users over five uses resulting in an average friction force of 1.29 N. To calculate friction, $$F_k = \mu_k F_N,$$

where, $F_k$ is the kinetic friction;

$\mu_k$ is the kinetic coefficient of friction; and $F_N$ is the force applied normal to the skin surface.

TABLE I

| Friction Force Values | | | |
|---|---|---|---|
| # | User 1 | User 2 | User 3 |
| 1 | 1.4 | 1.2 | 1.3 |
| 2 | 1.5 | 1.2 | 1.3 |
| 3 | 1.4 | 1.2 | 1.3 |
| 4 | 1.4 | 1.15 | 1.25 |
| 5 | 1.35 | 1.2 | 1.2 |
| Mean (N) | 1.410 | 1.190 | 1.270 |
| Std | 0.055 | 0.022 | 0.045 |
| Min | 1.35 | 1.15 | 1.2 |
| Max | 1.5 | 1.2 | 1.3 |
| | | Dry | |
| Average (N) | | 1.29 | |

Figure 3:
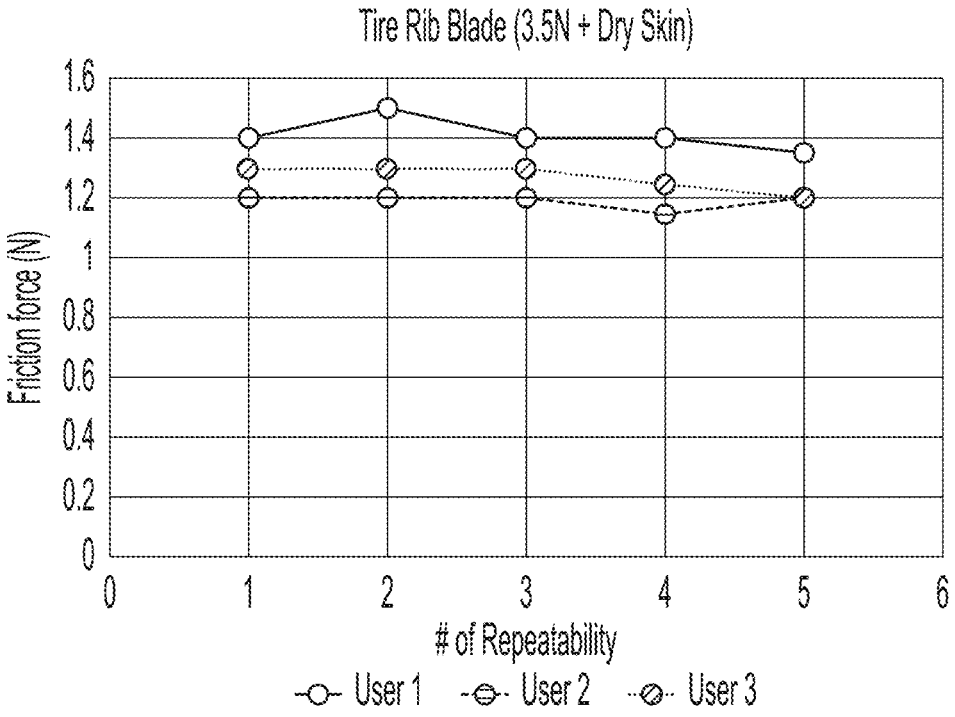
FIG. 3 is a graph of kinetic friction force using the blade housing of FIG. 2, according to one or more embodiments shown and described herein.

The tests were simulated applying a 3.5 N force on dry skin using the hair clipper 10. FIG. 3 illustrates the results in graph form. As can be seen, the friction force applied against dry skin was no more than 1.5 N. FIG. 4 illustrates a test condition where 3.5 N normal force is applied against skin S.

Figure 5:
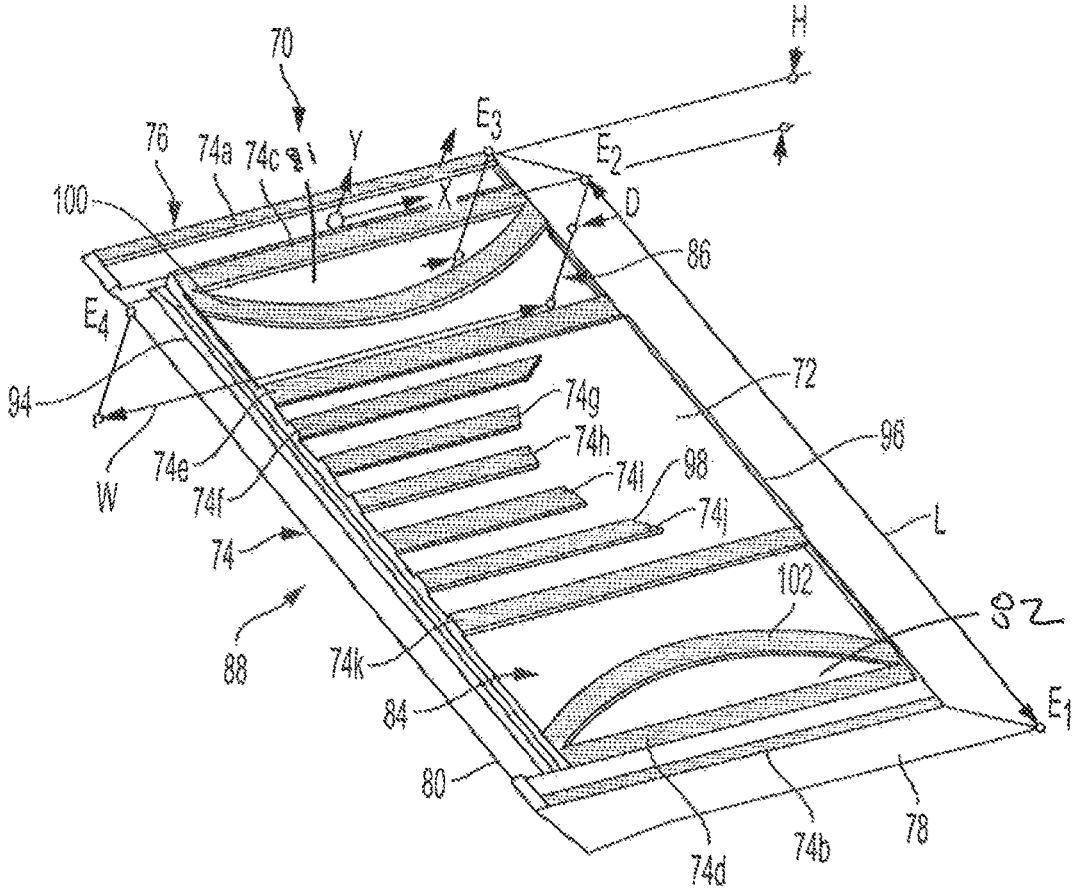
FIG. 5 is a perspective view of another blade housing for use with the hair clipper of FIG. 1, according to one or more embodiments shown and described herein.
Figure 6:
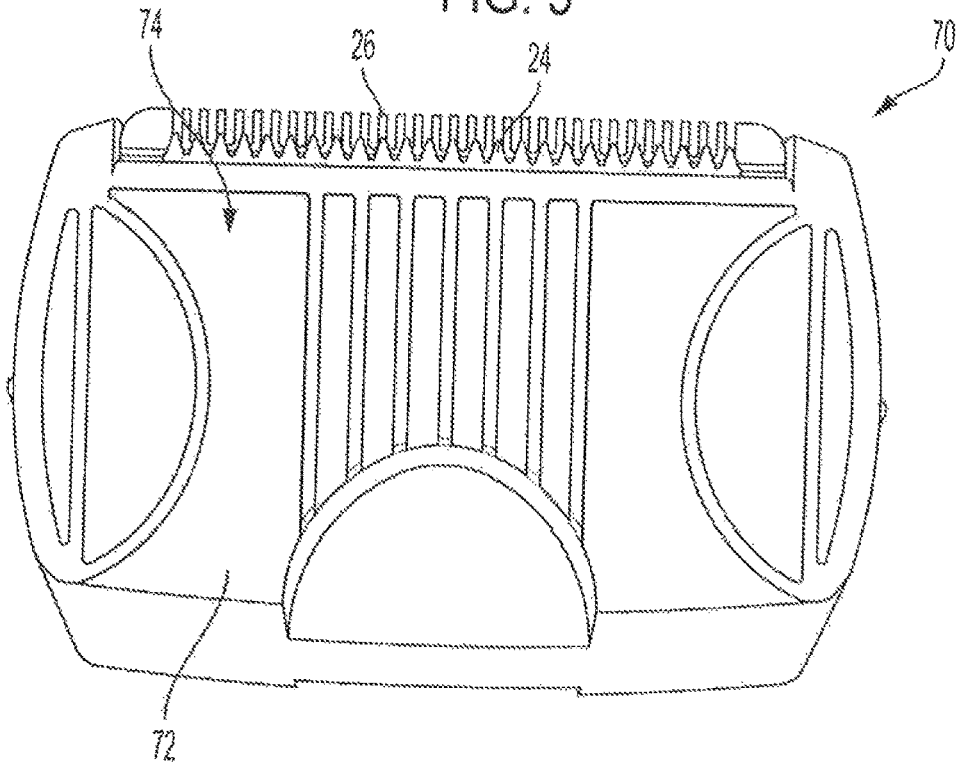
FIG. 6 is a top view of a blade assembly including the blade housing of FIG. 5, according to one or more embodiments shown and described herein.

Referring to FIGS. 5 and 6, another embodiment of a blade housing 70 is illustrated in isolation. The blade housing 70 has a guide surface 72 having a patterned array of ribs 74 located thereon. The ribs 74 are raised from the guide surface 72 to define a guide plane that is substantially parallel to the guide surface 72, as described above. In an XY coordinate plane including an X-axis and a Y-axis, FIG. 5 shows a length L between endpoints E1 and E2 at bottom edges of bottom surface 80, a vertical distance H along the Y-axis between endpoints E2 and E3 at a top edge of the guide surface 72, a horizontal distance D along the X-axis between endpoints E2 and E3, and a width W between endpoints E2 and E4 at an opposing bottom edge of the bottom surface 80. In an embodiment of FIG. 4, the length L may be approximately 48.30 mm, a radius of endpoint E2 may be 0.20 mm, a radius of endpoint E3 may be 0.50 mm, the vertical distance H may be 6 mm, the horizontal distance D may be 6.50 mm, and the width W may be 25.32 mm. Endpoint E2 may be angled with respect to endpoint E3 at about 42.71 degrees. Further similar to FIG. 4, in embodiments, the width W may be in a range of from about 40% to about 60% of the length L, and the vertical distance D may be in a range of from about 80% to 100% of the horizontal distance D and in a range of from about 5% to 20% of the length L.

The ribs 74 extend along a width of the guide surface 72. In particular, the patterned array of ribs 74 include outermost ribs 74*a* and 74*b* that extend along sides 76 and 78 of the blade housing 70. Inboard of the outermost ribs 74*a* and 74*b* are side ribs 74*c* and 74*d* that extend along sides 81 and 82 of the guide surface 72. The side ribs 74*c* and 74*d* extend the entire width of the guide surface 72. Interior ribs 74*e*-74*k* are located inboard of the side ribs 74*c* and 74*d* and are spaced inboard from the side ribs 74*c* and 74*d* providing spaced regions 84 and 86. In some embodiments, the spaced regions 84 and 86 may each be at least about 10 percent of the length of the guide surface 72, such as at least about 15 percent, such as at least about 20 percent of the length of the guide surface 72. In this regard, an inboard region 88 of the guide surface 72 may have a higher rib density per unit length than adjacent outboard regions 84 and 86.

Interior ribs 74*e* and 74*k* extend along sides of the inboard region 88 and each extends the entire width of the guide surface 72. Inboard of ribs 74*e* and 74*k* are central ribs 74*f*-74*j*. The central ribs 74*f*-74*j* only partially extend of the width of the guide surface 72, intersecting or beginning at front edge 94 of the guide surface 72 and terminating before rear edge 96. In some embodiments, rear edges 98 of the central ribs 74*f*-74*j* may be side beveled toward the sides 76 and 78 of the guide surface 72 thereby forming a somewhat rounded edge pattern. As can be seen, ribs 74*f* and 74*j* are longer than ribs 74*g*-74*i*, which are the shortest ribs 74. Each of the ribs 74 may have a length (in the X-direction) that is much greater than their width, such as at least about 2 times their width, such as at least about 3 times their width, such as at least about 4 times their width, such as at least about 5 times their width. Space is provided between the ribs 74*f*-74*j* to provide a somewhat undulating pattern of ribs and valleys.

Example

A pressure sensor (e.g., a resistor) was attached to the guide surface 36 of the blade housing 22. A weight (0.5 lb) was attached to the clipper body 12 in order to achieve 3.5 N. Three different users applied a horizontal force against the clipper body 12 with the guide surface 36 located on a horizontal sample of synthetic skin. The horizontal force was applied without any added vertical force and was slowly increased until the static friction force was overcome and the guide surface moved along the synthetic skin sample. The maximum friction force was determined using the output from the pressure sensor during this transition between static and kinetic conditions and was recorded. A linear actuator may be used to move the hair clipper 10.

Unlike the embodiment of FIG. 2, the spaced regions 84 and 86 includes round ribs 100 and 102 in the form of arcs. The round ribs 100 and 102 may each intersect their respective outermost rib 74*a* and 74*b* at opposite ends.

TABLE II

| Friction Force Values | | | |
|---|---|---|---|
| # | User 1 | User 2 | User 3 |
| 1 | 1.1 | 0.97 | 1.16 |
| 2 | 1.11 | 0.84 | 0.9 |
| 3 | 0.79 | 0.92 | 1.22 |
| 4 | 0.96 | 0.63 | 1.05 |
| 5 | 0.93 | 0.82 | 0.78 |
| Mean (N) | 0.978 | 0.836 | 1.022 |
| Std | 0.133 | 0.130 | 0.182 |
| Min | 0.79 | 0.63 | 0.78 |
| Max | 1.11 | 0.92 | 1.22 |
| | | Dry | |
| Average (N) | | 0.95 | |

Figure 7:
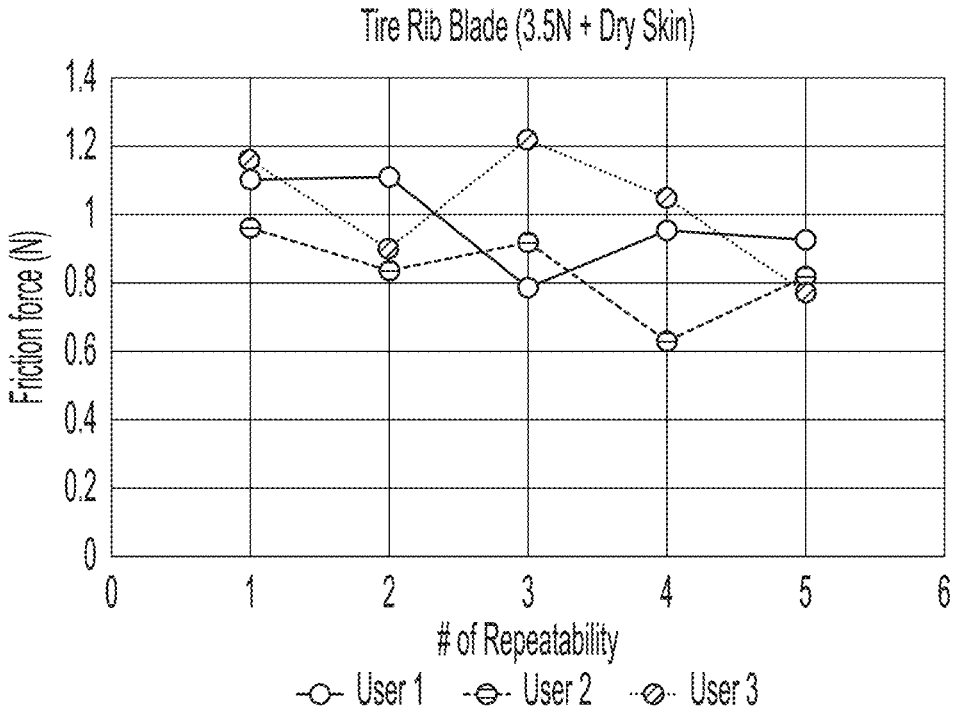
FIG. 7 is a graph of kinetic friction force using the blade housing of FIG. 5, according to one or more embodiments shown and described herein.

While the arcuate ribs 100 and 102 may increase the skin surface contact area compared to the rib pattern of FIG. 2, it has been found that the ribs 100 and 102 can reduce the average kinetic friction against the skin as shown by Table II under real testing conditions as described above. As can be seen, the friction force applied against dry skin was no more than 1.5 N, such as less than 1 N, such as less than 0.99 N. FIG. 7 illustrates the results in graph form.

Figure 8:
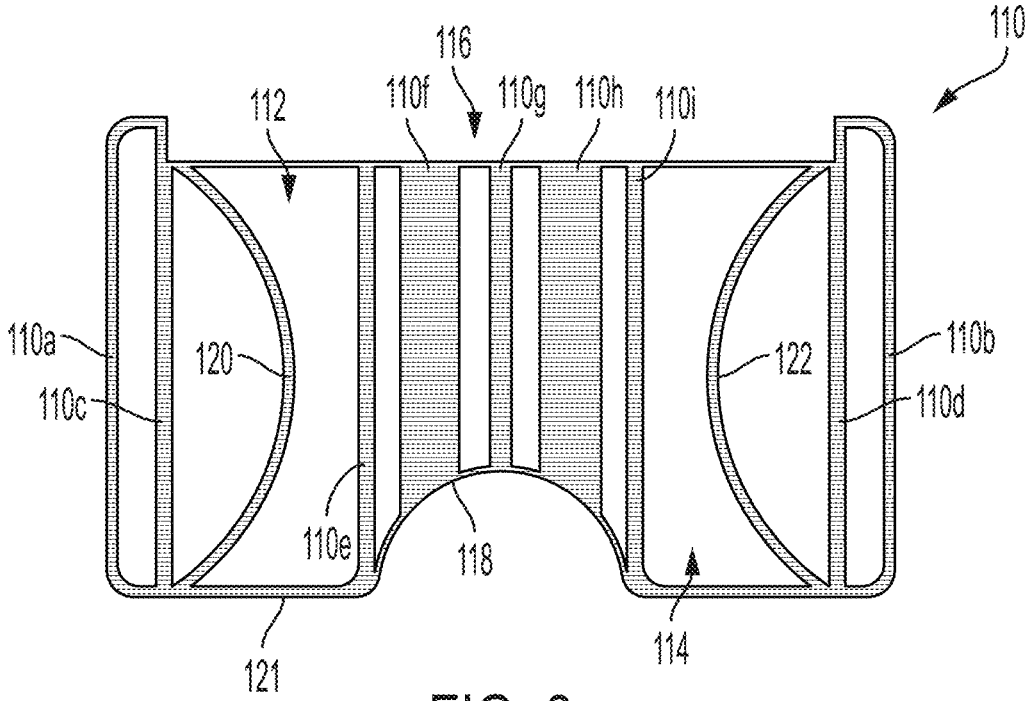
FIG. 8 illustrates a patterned array of ribs for use with a blade housing, according to one or more embodiments shown and described herein.

Referring to FIG. 8, another patterned array of ribs 110 is illustrated for use on a blade surface of a blade housing in a fashion similar to those described above. The ribs 110 extend along a width of the guide surface. In particular, the patterned array of ribs 110 include outermost ribs 110*a* and 110*b* that extend along sides of the blade housing. Inboard of the outermost ribs 110*a* and 110*b* are side ribs 110*c* and 110*d* that extend along sides of the guide surface. The side ribs 110*c* and 110*d* extend the entire width of the guide surface. Interior ribs 110*e*-110*i* are located inboard of the side ribs 110*c* and 110*d* and are spaced inboard from the side ribs 110*c* and 110*d* providing spaced regions 112 and 114. In some embodiments, the spaced regions 112 and 114 may each be at least about 10 percent of the length of the guide surface, such as at least about 15 percent, such as at least about 20 percent of the length of the guide surface. In this regard, an inboard region 116 of the guide surface may have a higher rib density per unit length than adjacent outboard regions 112 and 114.

Interior ribs 110*e* and 110*i* extend along sides of the inboard region 116 and each extends the entire width of the guide surface. Inboard of ribs 110*e* and 110*i* are central ribs 110*f* and 110*h*. The central ribs 110*f* and 110*h* only partially extend of the width of the guide surface. In some embodiments, rear edges 118 of the central ribs 110*f* and 110*h* may be side beveled toward the sides of the guide surface thereby forming a somewhat rounded edge pattern. It should be noted that a frame 121 may be removed one the ribs 110 are formed. The central ribs 110*f* and 110*h* have an increased width compared to the ribs 110*e* and 110*i*. In this regard, the ribs 110 need not all have the same width and may have different widths. A rib 110*g* is located between the central ribs 110*f* and 110*h*.

The spaced regions 112 and 114 includes round ribs 120 and 122 in the form of arcs. The round ribs 120 and 122 may each intersect their respective outermost rib 110*a* and 110*b* at opposite ends.

Figure 9:
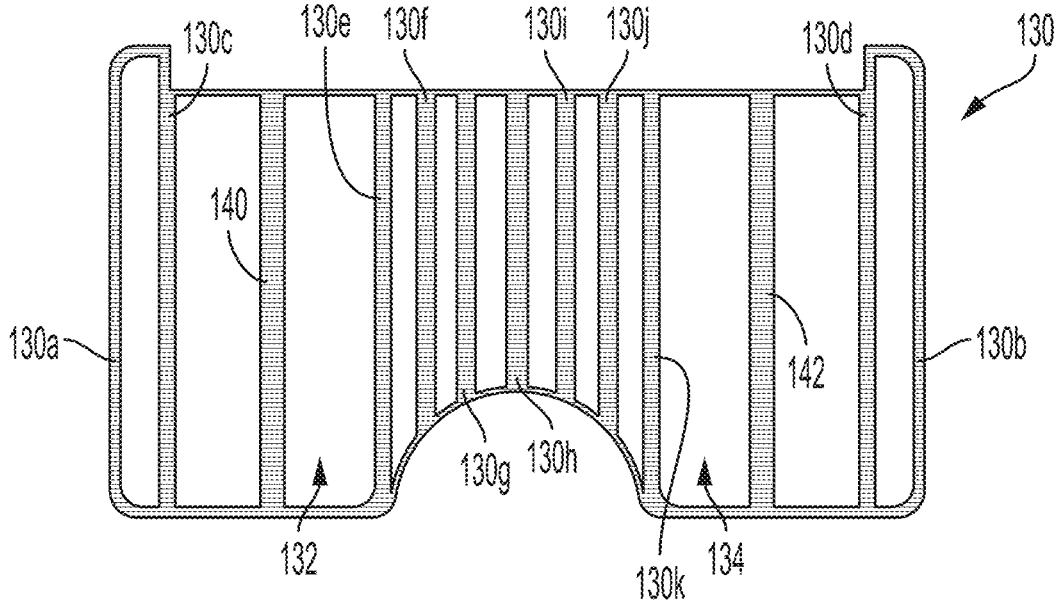
FIG. 9 illustrates another patterned array of ribs for use with a blade housing, according to one or more embodiments shown and described herein.

Referring to FIG. 9, another patterned array of ribs 130 is illustrated for use on a blade surface of a blade housing in a fashion similar to those described above. The ribs 130 extend along a width of the guide surface. In particular, the patterned array of ribs 130 include outermost ribs 130*a* and 130*b* that extend along sides of the blade housing. Inboard of the outermost ribs 130*a* and 130*b* are side ribs 130*c* and 130*d* that extend along sides of the guide surface. The side ribs 130*c* and 130*d* extend the entire width of the guide surface. Interior ribs 130*e*-130*k* are located inboard of the side ribs 130*c* and 130*d* and are spaced inboard from the side ribs 130*c* and 130*d* providing spaced regions 132 and 134. In some embodiments, the spaced regions 132 and 134 may each be at least about 10 percent of the length of the guide surface, such as at least about 15 percent, such as at least about 20 percent of the length of the guide surface. In this regard, an inboard region 136 of the guide surface may have a higher rib density per unit length than adjacent outboard regions 132 and 134.

Interior ribs 130*e* and 130*k* extend along sides of the inboard region 136 and each extends the entire width of the guide surface. Inboard of ribs 130*e* and 130*k* are central ribs 130*f*-130*j*. The central ribs 130*f*-130*j* only partially extend of the width of the guide surface. In some embodiments, rear edges 138 of the central ribs 130*f*-130*k* may be side beveled toward the sides of the guide surface thereby forming a somewhat rounded edge pattern.

The spaced regions 132 and 134 include straight ribs 140 and 142. The ribs 140 and 142 may extend the entire width of the guide surface.

A method of using the hair clipper for hair removal from a skin area of a patient may include coupling the blade assembly 20 to the clipper body 12 of the surgical clipper 10. The blade assembly 20 includes, as described herein, the blade 24, the guide surface 36 and an aperture configured to receive the blade 24 and defined between an end portion of the guide surface 36. The patterned array of ribs 40 is located on the guide surface 36 and define the guide plane that contacts the skin. The method includes facing the guide surface 36 and the ribs 40 of the hair clipper 10 against the skin area, and operating the blade 24 through the body 12 to remove hair from the skin area of the patient such that the ribs 40 reduce friction forces during blade operation and inhibits skin abrasions during blade operation.

As described herein, the body 12 of the surgical clipper 10 is configured to electronically operate the blade 24. The body 12 includes the enclosure housing an electrical motor and a battery, which battery is configured to be rechargeable through coupling of the body 12 to a charging adaptor 18. The body 12 of the surgical clipper 10 further may include a charge indicator configured to indicate a low battery level of the battery below a predefined threshold. The method may include triggering an alarm through the charge indicator of the low battery level, coupling the body to the charging adaptor, and recharging the battery. The alarm may be a visual, audio, or tactile alarm. Such a visual alarm may be an LED light that may, for example, red to indicate the low battery level.

In the embodiments described herein, use of the ribs 40, 74, 100, 102, 110, 120, 122, 130, 140, 142 disposed on at least a portion of a top skin facing surface configured to contact the skin area, the portion including the top surface and the blade results in a reduction of friction forces when using the hair clipper for hair removal at a skin area of a patient than may result without the ribs. Such reduced friction forces aids to reduce a risk of skin nicking that could lead to surgical site infections, aids is the agility and maneuverability of the hair clipper on the skin area, and aids to reduce stickiness and adherence of aqueous solutions from the skin area to the hair clipper.

The patterned array of ribs may be formed by any suitable method, such as by etching, molding and/or machining. A suitable material may be acrylonitrile butadiene styrene (ABS). In some embodiments, the patterned array of ribs may be formed separately from the glade housing and attached thereto (e.g., by welding, adhesive, etc.). In other embodiments, the patterned array of ribs may be formed monolithic with the blade housing, such as by molding the blade housing and the plurality of ribs together. In embodiments where the patterned array of ribs are formed separately from the blade housing, different patterns of the array of ribs may be interchangeable and removably connected to the housing to provide different and selectable friction profiles.

Embodiments can be described with reference to the following numbered clauses, with preferred features laid out in the dependent clauses:

Clause 1. A hair clipper comprising: a clipper body comprising a motor; and a blade assembly connected to the clipper body such that the motor moves a moveable blade of the blade assembly during operation, the blade assembly comprising a blade housing having a guide surface that faces skin of a patient during operation and a patterned array of ribs that are located on the guide surface defining a guide plane; wherein the ribs of the patterned array of ribs are arranged spaced-apart from one another and are sized to provide a kinetic friction force against dry skin of the patient of less than 1 N using a normal force of 3.5 N.

Clause 2. The hair clipper of clause 1, wherein the ribs have a skin contact surface area of no greater than about 3 $cm^2$.

Clause 3. The hair clipper of clause 1 or 2, wherein the guide surface has a surface area of between about 10 $cm^2$ and about 15 $cm^2$.

Clause 4. The hair clipper of clause 1-3, wherein the patterned array of ribs includes outermost ribs that extend along opposite sides of the blade housing and central ribs that extend along an inboard region of the guide surface, wherein the inboard region has a higher rib density than adjacent outboard regions.

Clause 5. The hair clipper of clause 4, wherein the adjacent outboard regions each include a spaced region that extends along at least about 10 percent of a length of the guide surface.

Clause 6. The hair clipper of clause 4 or 5, wherein the spaced region is devoid of ribs.

Clause 7. The hair clipper of clause 4 or 5, wherein the patterned array of ribs comprises a curved rib that is located in at least one of the adjacent outboard regions.

Clause 8. The hair clipper of clause 1-7, wherein the patterned array of ribs are monolithic with the guide surface.

Clause 9. The hair clipper of clause 1-8, wherein the blade assembly is removably connected to the clipper body.

Clause 10. A hair clipper comprising: a clipper body comprising a motor; and a blade assembly connected to the clipper body such that the motor moves a moveable blade of the blade assembly during operation, the blade assembly comprising a blade housing having a guide surface that faces skin of a patient during operation and a patterned array of ribs that are located on the guide surface defining a guide plane; wherein the patterned array of ribs includes outermost ribs that extend along opposite sides of the blade housing and central ribs that extend along an inboard region of the guide surface, wherein the inboard region has a higher rib density than adjacent outboard regions.

Clause 11. The hair clipper of clause 10, wherein the adjacent outboard regions each include a spaced region that extends along at least about 10 percent of a length of the guide surface.

Clause 12. The hair clipper of clause 10 or 11, wherein the patterned array of ribs comprises a curved rib that is located in at least one of the adjacent outboard regions.

Clause 13. The hair clipper of clause 10-12, wherein the ribs have a skin contact surface area of no greater than about 3 $cm^2$.

Clause 14. The hair clipper of clause 10-13, wherein the guide surface has a surface area of between about 10 $cm^2$ and about 15 $cm^2$.

Clause 15. The hair clipper of clause 10-14, wherein the patterned array of ribs are monolithic with the guide surface.

Clause 16. The hair clipper of clause 10-15, wherein the blade assembly is removably connected to the clipper body.

Clause 17. A method of using a hair clipper for hair removal from a skin area of a patient, the method comprising: coupling a blade assembly to a clipper body of the hair clipper, the surgical clipper blade assembly comprising: a clipper body comprising a motor; and a blade assembly connected to the clipper body such that the motor moves a moveable blade of the blade assembly during operation, the blade assembly comprising a blade housing having a guide surface that faces skin of a patient during operation and a patterned array of ribs that are located on the guide surface defining a guide plane; wherein the ribs of the patterned array of ribs are arranged spaced-apart from one another and are sized to provide a kinetic friction force against dry skin of the patient of no greater than 1.5 N using a normal force of 3.5 N; facing the guide surface toward the skin area such that the patterned array of ribs contacts the skin area; and operating the blade assembly to remove hair from the skin area.

Clause 18. The method of clause 17, wherein the patterned array of ribs includes outermost ribs that extend along opposite sides of the blade housing and central ribs that extend along an inboard region of the guide surface, wherein the inboard region has a higher rib density than adjacent outboard regions.

Clause 19. The method of clause 17 or 18, wherein the ribs have a skin contact surface area of no greater than about 3 $cm^2$.

Clause 20. The method of clause 17-19, wherein the guide surface has a surface area of between about 10 $cm^2$ and about 15 $cm^2$.

Clause 21. A blade assembly that connects to a clipper body of a hair clipper such that a motor moves a moveable blade of the blade assembly during operation, the blade assembly comprising: a blade housing having a guide surface that faces skin of a patient during operation and a patterned array of ribs that are located on the guide surface defining a guide plane; wherein the ribs of the patterned array of ribs are arranged spaced-apart from one another and are sized to provide a kinetic friction force against dry skin of the patient of less than 1 N using a normal force of 3.5 N.

Clause 22. The blade assembly of clause 21, wherein the ribs have a skin contact surface area of no greater than about 3 $cm^2$.

Clause 23. The blade assembly of clause 22, wherein the guide surface has a surface area of between about 10 $cm^2$ and about 15 $cm^2$.

Clause 24. The blade assembly of clause 21-23, wherein the patterned array of ribs includes outermost ribs that extend along opposite sides of the blade housing and central ribs that extend along an inboard region of the guide surface, wherein the inboard region has a higher rib density than adjacent outboard regions.

Clause 25. The blade assembly of clause 24, wherein the adjacent outboard regions each include a spaced region that extends along at least about 10 percent of a length of the guide surface.

Clause 26. The blade assembly of clause 24 or 25, wherein the spaced region is devoid of ribs.

Clause 27. The blade assembly of clause 24-26, wherein the patterned array of ribs comprises a curved rib that is located in at least one of the adjacent outboard regions.

Clause 28. The blade assembly of clause 21-27, wherein the patterned array of ribs are monolithic with the guide surface.

Clause 29. The blade assembly of clause 21-28, wherein the blade assembly is removably connected to the clipper body.

Clause 30. A blade housing that connects to a clipper body of a powered hair clipper, the blade housing comprising: a guide surface that faces skin of a patient during operation and a patterned array of ribs that are located on the guide surface defining a guide plane; wherein the ribs of the patterned array of ribs are arranged spaced-apart from one another and are sized to provide a kinetic friction force against dry skin of the patient of less than 1 N using a normal force of 3.5 N.

Clause 31. The blade housing of clause 30, wherein the ribs have a skin contact surface area of no greater than about 3 $cm^2$.

Clause 32. The blade housing of clause 31, wherein the guide surface has a surface area of between about 10 $cm^2$ and about 15 $cm^2$.

Clause 33. The blade housing of clause 30-32, wherein the patterned array of ribs includes outermost ribs that extend along opposite sides of the blade housing and central ribs that extend along an inboard region of the guide surface, wherein the inboard region has a higher rib density than adjacent outboard regions.

Clause 34. The blade housing of clause 33, wherein the adjacent outboard regions each include a spaced region that extends along at least about 10 percent of a length of the guide surface.

Clause 35. The blade housing of clause 33 or 34, wherein the spaced region is devoid of ribs.

Clause 36. The blade housing of clause 33-35, wherein the patterned array of ribs comprises a curved rib that is located in at least one of the adjacent outboard regions.

Clause 37. The blade housing of clause 30-36, wherein the patterned array of ribs are monolithic with the guide surface.

Clause 38. The blade housing of clause 30-37, wherein the blade assembly is removably connected to the clipper body.

For the purposes of describing and defining the present disclosure, it is noted that recitations herein of "at least one" component, element, etc., should not be used to create an inference that the alternative use of the articles "a" or "an" should be limited to a single component, element, etc.

It is noted that recitations herein of a component of the present disclosure being "configured" in a particular way, to embody a particular property, or to function in a particular manner, are structural recitations, as opposed to recitations of intended use. More specifically, the references herein to the manner in which a component is "configured" denotes an existing physical condition of the component and, as such, is to be taken as a definite recitation of the structural characteristics of the component.

For the purposes of describing and defining the present disclosure it is noted that the terms "substantially" and "approximately" and "about" are utilized herein to represent the inherent degree of uncertainty that may be attributed to any quantitative comparison, value, measurement, or other representation. The terms "substantially" and "approximately" and "about" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present disclosure, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A hair clipper comprising:

a clipper body comprising a motor; and a blade assembly connected to the clipper body such that the motor moves a moveable blade of the blade assembly during operation, the blade assembly comprising a blade housing having a guide surface that faces skin of a patient during operation and a patterned array of ribs that are located on the guide surface defining a guide plane;

wherein the ribs of the patterned array of ribs are arranged spaced-apart from one another and include outermost ribs that extend along opposite sides of the blade housing and central ribs that extend along an inboard region of the guide surface, wherein the inboard region has a higher rib density per unit length than that of outboard regions of the guide surface, and the inboard region is between the outboard regions.

2. The hair clipper of claim 1, wherein the ribs have a skin contact surface area of no greater than half of the guide surface.

3. The hair clipper of claim 2, wherein the guide surface has a surface area in the range of between 10 $cm^2$ and 15 $cm^2$.

4. The hair clipper of claim 1, wherein the adjacent outboard regions each include a spaced region that extends along no less than 10 percent of a length of the guide surface.

5. The hair clipper of claim 4, wherein the spaced region is devoid of ribs.

6. The hair clipper of claim 1, wherein the patterned array of ribs comprises a curved rib that is located in at least one of the adjacent outboard regions.

7. The hair clipper of claim 1, wherein the patterned array of ribs are monolithic with the guide surface.

8. The hair clipper of claim 1, wherein the blade assembly is removably connected to the clipper body.

9. A blade assembly connectable to a clipper body comprising a motor that moves a moveable blade of the blade assembly during operation, the blade assembly comprising:

a blade housing having a guide surface that faces skin of a patient during operation and a patterned array of ribs that are located on the guide surface defining a guide plane;

wherein the patterned array of ribs includes outermost ribs that extend along opposite sides of the blade housing and central ribs that extend along an inboard region of the guide surface, wherein the inboard region has a higher rib density per unit length than that of outboard regions of the guide surface, and the inboard region is between the outboard regions.

10. The blade assembly of claim 9, wherein the adjacent outboard regions each include a spaced region that extends along no less than 10 percent of a length of the guide surface.

11. The blade assembly of claim 9, wherein the patterned array of ribs comprises a curved rib that is located in at least one of the adjacent outboard regions.

12. The hair clipper blade assembly of claim 9, wherein the ribs have a skin contact surface area of no greater than half the guide surface.

13. The blade assembly of claim 12, wherein the guide surface has a surface area in the range of between 10 $cm^2$ and 15 $cm^2$.

14. The blade assembly of claim 9, wherein the patterned array of ribs are monolithic with the guide surface.

15. The blade assembly of claim 9, wherein the blade assembly is removably connectable to the clipper body.

16. A method of using a hair clipper for hair removal from a skin area of a patient, the method comprising:

coupling a blade assembly to a clipper body of the hair clipper, the hair clipper comprising:

the clipper body comprising a motor; and the blade assembly connected to the clipper body such that the motor moves a moveable blade of the blade assembly during operation, the blade assembly comprising a blade housing having a guide surface that faces skin of a patient during operation and a patterned array of ribs that are located on the guide surface defining a guide plane;

wherein the ribs of the patterned array of ribs are arranged spaced-apart from one another and include outermost ribs that extend along opposite sides of the blade housing and central ribs that extend along an inboard region of the guide surface, wherein the inboard region has a higher rib density per unit length than that of outboard regions of the guide surface, and the inboard region is between the outboard regions;

facing the guide surface toward the skin area such that the patterned array of ribs contacts the skin; and operating the blade assembly to remove hair from the skin.

17. The method of claim 16, wherein the ribs have a skin contact surface area of no greater than half of the guide surface.

18. The method of claim 16, wherein the guide surface has a surface area in the range of between 10 $cm^2$ and 15 $cm^2$.

* * * * *